US005327844A

United States Patent [19]

Kress

[11] Patent Number: 5,327,844

[45] Date of Patent: Jul. 12, 1994

[54] CLEAT COVER

[76] Inventor: James R. Kress, 511 W. Tenth St., Erie, Pa. 16502

[21] Appl. No.: 950,707

[22] Filed: Sep. 25, 1992

[51] Int. Cl.[5] ..... B63B 21/04

[52] U.S. Cl. ..... 114/218; 150/154; 150/166; 114/361; 114/364

[58] Field of Search ..... 114/218, 361, 364; 135/73; 150/154, 155, 166

[56] References Cited

U.S. PATENT DOCUMENTS

| | | | |
|---|---|---|---|
| 1,402,496 | 1/1922 | Hoffman . | |
| 1,565,582 | 12/1925 | Moore | 135/73 |
| 1,673,609 | 6/1928 | Weis | 135/73 |
| 2,555,805 | 6/1951 | Miller | 114/218 |
| 3,093,106 | 6/1963 | Lippincott | 114/218 |
| 3,126,859 | 3/1964 | Bigelow | 114/218 |
| 3,198,160 | 8/1965 | Anderson | 114/218 |
| 3,269,400 | 8/1966 | Smith et al. | 135/73 |
| 4,270,478 | 6/1981 | Kafka et al. | 114/218 |
| 4,354,445 | 10/1982 | Kafka et al. | 114/218 |
| 4,685,500 | 8/1987 | Silvia | 150/52 R |

*Primary Examiner*—Sherman Basinger
*Assistant Examiner*—Thomas J. Brahan
*Attorney, Agent, or Firm*—Lovercheck and Lovercheck

[57] ABSTRACT

A one piece-torpedo shaped cleat cover having a body with a flat bottom, a central cavity and two end cavities to receive the base of a cleat and lateral arm cavities for receiving the ends of a cleat. The cover can be hooked over one arm of a cleat and the cover can then be stretched to hang over the other arm of the cleat then relaxed to enclose the cleat in a neat appearing safety directed cover.

1 Claim, 2 Drawing Sheets

FIG. 1
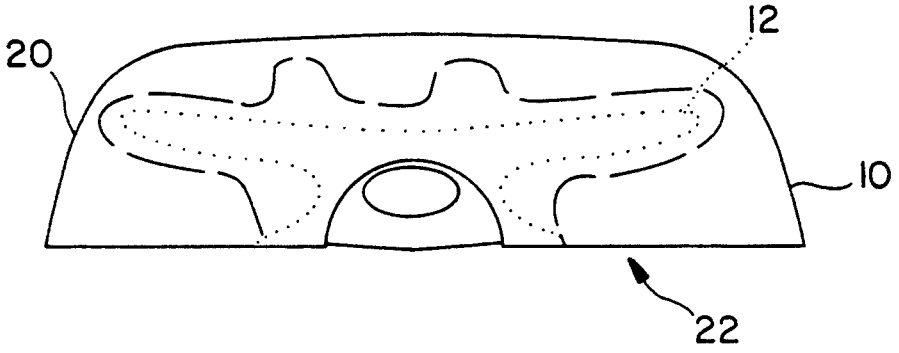
FIG. 2
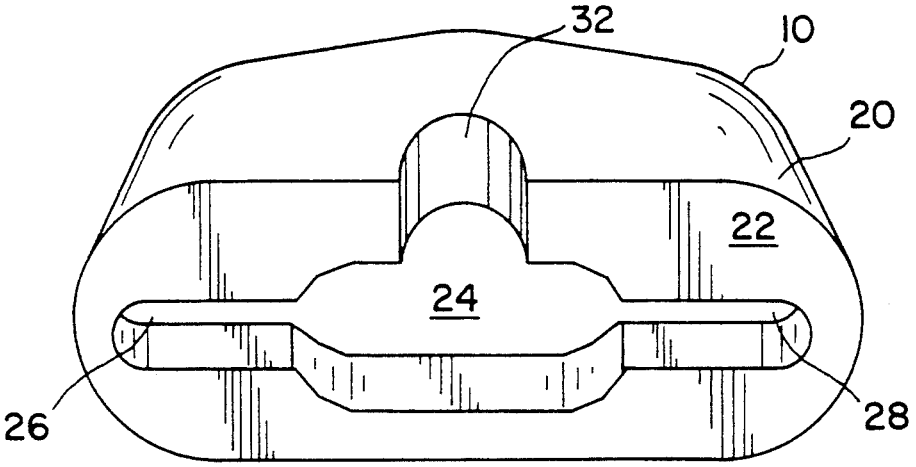
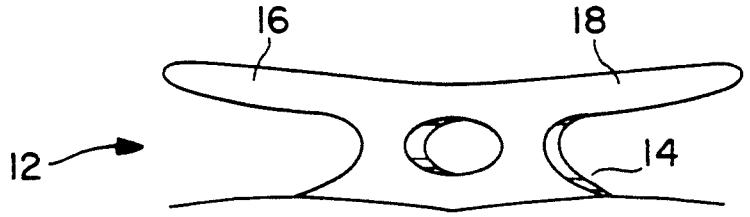
FIG. 3

FIG. 4
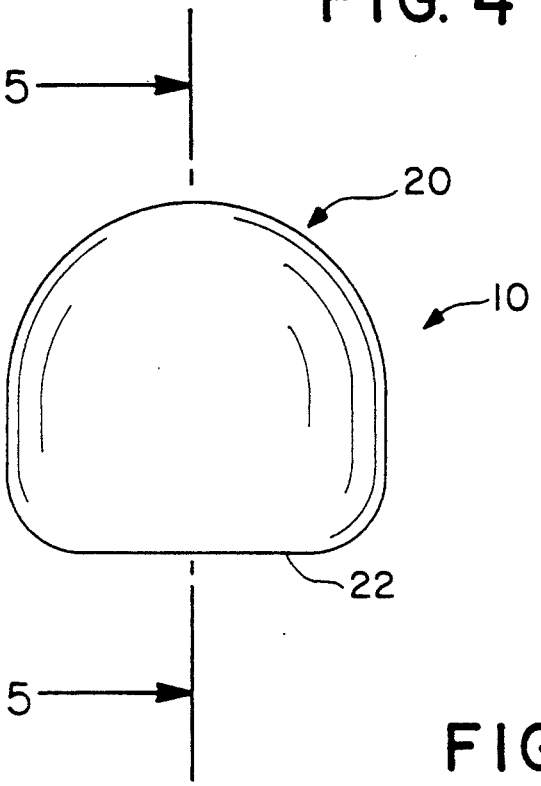
FIG. 5
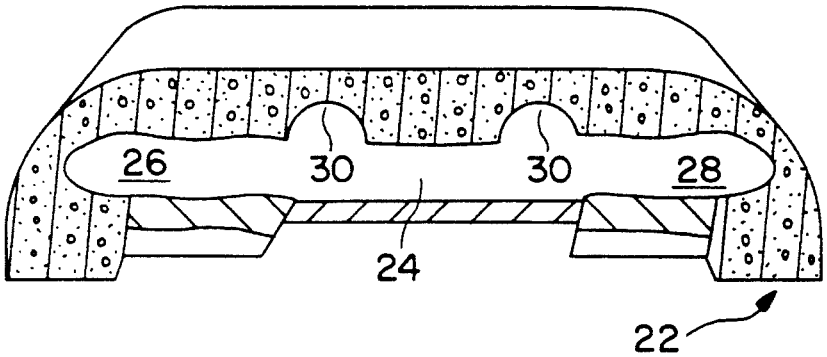
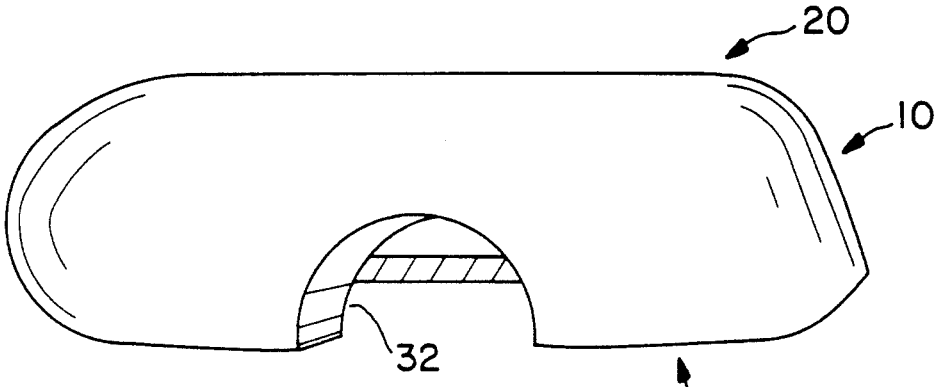
FIG. 6

CLEAT COVER

BACKGROUND OF THE INVENTION

Applicant noticed that there is a need for safety to people in or around boats and boat docking facilities. Due to the positioning of the metal cleats on boats, dock areas and due to the size and shape of such cleats, there is a constant potential need for personal safety.

Applicant's invention provides a one-piece cushion to cover a fixed cleat. This is easily applied cushion cleat to cover cleats with or without a rope affixed. The cushioning material could be a resilient polyethylene foam. The cushion will be larger than the intended cleat to provide ample room for a rope to be secured on the cleat. The cleat cover will be made of a resilient material so that the cleat will nest in it. Applicant's cushion will also be painted a highly visible color to give it an attractive appearance.

Applicant is aware of the following U.S. Patents:

U.S. Pat. No. 1,402,496 to Hoffman shows a housed cleat for submarine boats.

U.S. Pat. No. 2,555,805 to Miller shows a collapsible cleat.

U.S. Pat. No. 3,093,106 to Lippincott shows a flush mounted cleat.

U.S. Pat. No. 3,126,859 to Bigelow shows a cleat.

U.S. Pat. No. 3,198,160 to Anderson shows a cleat guard.

U.S. Pat. No. 4,270,478 to Kafka et al shows a disappearing cleat or fitting.

U.S. Pat. No. 4,354,445 to Kafka et al shows a retractable lift ring.

U.S. Pat. No. 4,685,500 to Silvia shows a two piece cleat cover.

None of these patents show a one-piece cleat cover made of resilient foam material that can be stretched over a cleat.

Cleats are used for boats, trucks and the like in which cleats are obstacles and stumbling blocks to persons using such boat docks, trucks or the like.

SUMMARY OF THE INVENTION

It is an object of the invention to provide a cover for a cleat to make it less of an obstacle.

Another object of the invention is to increase the visibility and cushion the rigid mounting of the cleats.

Another object of the invention is to provide a one-piece cushion in which the cleat will nest to cover a fixed cleat. Another object of the invention to provide a cleat cover that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or 15 sacrificing any of the advantages of the invention.

BRIEF DESCRIPTION OF THE DRAWING(S)

FIG. 1 is a side view of the cleat cover according to the invention.

FIG. 2 is an isometric view of the cleat cover.

FIG. 3 is a side view of a conventional cleat.

FIG. 4 is an end view of the cleat cover.

FIG. 5 is a longitudinal cross sectional view taken on line 5—5 of FIG. 4 of the cleat cover.

FIG. 6 is a side view of the cleat cover.

DESCRIPTION OF THE PREFERRED EMBODIMENT(S)

Now with more particular reference to the drawings, in which similar numerals refer to the same parts throughout the drawings of the invention. Cleat cover 10 is shown which is intended to fit over cleat 12. Cleat 12 is a conventional cleat of the kind commonly found around boats, boat docks and wharfs. Cleat 12 has base 14, first laterally extending arm 16 and second laterally extending arm 18 which are attached to base 14 and extend in opposite directions.

Cleat cover 10 is made up of integral one-piece body 20 and molded from a feasible resilient foam of thermoplastic material. Cleat cover 10 has relatively flat bottom 22 in a torpedo shape central cavity 24. Central cavity 24 has first arm cavity 26 and second arm cavity 28 adapted to receive first laterally extending arm 16 and second laterally extending arm 18 of cleat 12.

Cleat cover 10 may be installed on cleat 12 by passing first laterally extending arm 16 through central cavity 24 into either first arm cavity 26 or second arm cavity 28. Cleat cover 10 can then be stretched so that cleat cover 10 can be drawn over second laterally extending arm 18 or over first laterally extending arm 16 if cleat cover 10 was first put over second latrally extending arm 18. Cleat cover 10 can then be allowed to resiliently contract over second laterally extending arm 18 so that cleat 12 is completely covered and nestd in cleat cover 10. Cleat cover 10 is made sufficiently arge so that a rope can be wrapped around cleat 12 and the rope can then be received in recess 30 inside cleat cover 10 so as not to hold cleat cover 10 up from cleat 12. Notch 32 may receive the part of the rope that extends out of cleat cover 10.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A cover for a cleat having a base and two elongated laterally extending arms attached to said base and extending therefrom;

said cover comprising an integral body made of a resilient thermoplastic foam material and having a relatively flat bottom and a central cavity shaped to receive said base of said cleat;

two spaced laterally extending arm cavities are formed in said cover communicating with said central cavity and adapted to receive said arms of said cleat;

said cover being adapted to be installed on said cleat by inserting one said arm into one said arm cavity;

said cover being adapted to be stretched over the other said arm and inserting said arm into said other arm cavity;

said cover being held onto said cleat by the resiliency of the material of said cover; and wherein a notch is provided in each side of said cover communicating with said central cavity for receiving a rope which may be wrapped around said cleat.

* * * * *